US006505803B1

(12) United States Patent
Hernandez

(10) Patent No.: US 6,505,803 B1
(45) Date of Patent: Jan. 14, 2003

(54) CABINET MOUNTING SUPPORT DEVICE

(76) Inventor: Lin Hernandez, 3375 Reynard Way #2, San Diego, CA (US) 92103

( * ) Notice: Subject to any disclaimer, the term of this patent is extended or adjusted under 35 U.S.C. 154(b) by 0 days.

(21) Appl. No.: 09/765,653

(22) Filed: Jan. 22, 2001

(51) Int. Cl.[7] ..... A47F 5/00; E04G 25/00; F16M 13/00

(52) U.S. Cl. ..... 248/354.5; 248/354.3; 254/98; 312/245

(58) Field of Search ..... 248/125.9, 354.5, 248/188.5, 125.8, 354.1, 354.3, 354.4, 445, 416; 312/245; 52/126.6, 126.7; 254/98, 100

(56) References Cited

U.S. PATENT DOCUMENTS

| | | | | | |
|---|---|---|---|---|---|
| 306,581 | A | * | 10/1884 | Chase | 254/98 |
| 964,824 | A | * | 7/1910 | Tidd | 254/98 |
| 2,358,865 | A | | 9/1944 | Mcpherson | |
| 2,504,291 | A | | 4/1950 | Alderfer | |
| 3,313,505 | A | * | 4/1967 | Petrie | 248/354.5 |
| 3,650,591 | A | | 3/1972 | Longmire, Sr. | |
| 4,340,205 | A | | 7/1982 | Leezer | |
| 4,482,130 | A | | 11/1984 | Paredes | |
| 4,684,097 | A | * | 8/1987 | Cox | 248/354.3 |
| 5,169,219 | A | | 12/1992 | Obbink | |
| D389,980 | S | | 1/1998 | Friz | |
| 6,019,337 | A | * | 2/2000 | Brown | 248/354.4 |
| 6,199,828 | B1 | * | 3/2001 | Komperud | 254/100 |

* cited by examiner

*Primary Examiner*—Korie Chan
*Assistant Examiner*—Gwendolyn Baxter

(57) ABSTRACT

A cabinet mounting support device for supporting a cabinet at a selected height for mounting the cabinet. The cabinet mounting support device includes a base plate. A substantially hollow first tubular member is elongated and has a first end securely coupled to a top surface of the base plate such that the first tubular member is in a generally vertical orientation. The first tubular member has a plurality of pairs of opposed and aligned apertures therein extending between the first and second ends of the first tubular member. A second tubular member is elongated and has a first end and a second end. The second tubular member is substantially hollow. The first end is movably extendable into a second end of the first tubular member such that the second tubular member is telescopic with respect to the first tubular member. The second tubular member has a pair of opposed apertures therein positioned generally adjacent to the first end of the second tubular member. A pin is removably extendable through a pair of opposed apertures in the first tubular member and into the apertures in the second tubular member. A support portion rotatably supports a cabinet on the second end of the second tubular member comprising.

1 Claim, 3 Drawing Sheets

CABINET MOUNTING SUPPORT DEVICE

BACKGROUND OF THE INVENTION

1. Field of the Invention

The present invention relates to construction support devices and more particularly pertains to a new cabinet mounting support device for supporting a cabinet at a selected height for mounting the cabinet.

2. Description of the Prior Art

The use of construction support devices is known in the prior art. More specifically, construction support devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,504,291; 389,980; 4,482,130; 3,650,591; 5,169,219; 2,358,865; and 4,340,205.

While these devices fulfill their respective, particular objectives and requirements, the aforementioned patents do not disclose a new cabinet mounting support device. The inventive device includes a base plate. A substantially hollow first tubular member is elongated and has a first end securely coupled to a top surface of the base plate such that the first tubular member is in a generally vertical orientation. The first tubular member has a plurality of pairs of opposed and aligned apertures therein extending between the first and second ends of the first tubular member. A second tubular member is elongated and has a first end and a second end. The second tubular member is substantially hollow. The first end is movably extendable into a second end of the first tubular member such that the second tubular member is telescopic with respect to the first tubular member. The second tubular member has a pair of opposed apertures therein positioned generally adjacent to the first end of the second tubular member. A pin is removably extendable through a pair of opposed apertures in the first tubular member and into the apertures in the second tubular member. A support portion rotatably supports a cabinet on the second end of the second tubular member comprising.

In these respects, the cabinet mounting support device according to the present invention substantially departs from the conventional concepts and designs of the prior art, and in so doing provides an apparatus primarily developed for the purpose of supporting a cabinet at a selected height for mounting the cabinet.

SUMMARY OF THE INVENTION

In view of the foregoing disadvantages inherent in the known types of construction support devices now present in the prior art, the present invention provides a new cabinet mounting support device construction wherein the same can be utilized for supporting a cabinet at a selected height for mounting the cabinet.

The general purpose of the present invention, which will be described subsequently in greater detail, is to provide a new cabinet mounting support device apparatus and method which has many of the advantages of the construction support devices mentioned heretofore and many novel features that result in a new cabinet mounting support device which is not anticipated, rendered obvious, suggested, or even implied by any of the prior art construction support devices, either alone or in any combination thereof.

To attain this, the present invention generally comprises a base plate. A substantially hollow first tubular member is elongated and has a first end securely coupled to a top surface of the base plate such that the first tubular member is in a generally vertical orientation. The first tubular member has a plurality of pairs of opposed and aligned apertures therein extending between the first and second ends of the first tubular member. A second tubular member is elongated and has a first end and a second end. The second tubular member is substantially hollow. The first end is movably extendable into a second end of the first tubular member such that the second tubular member is telescopic with respect to the first tubular member. The second tubular member has a pair of opposed apertures therein positioned generally adjacent to the first end of the second tubular member. A pin is removably extendable through a pair of opposed apertures in the first tubular member and into the apertures in the second tubular member. A support portion rotatably supports a cabinet on the second end of the second tubular member comprising.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cabinet mounting support device apparatus and method which has many of the advantages of the construction support devices mentioned heretofore and many novel features that result in a new cabinet mounting support device which is not anticipated, rendered obvious, suggested, or even implied by any of the prior art construction support devices, either alone or in any combination thereof.

It is another object of the present invention to provide a new cabinet mounting support device which may be easily and efficiently manufactured and marketed.

It is a further object of the present invention to provide a new cabinet mounting support device which is of a durable and reliable construction.

An even further object of the present invention is to provide a new cabinet mounting support device which is susceptible of a low cost of manufacture with regard to both materials and labor, and which accordingly is then susceptible of low prices of sale to the consuming public, thereby making such cabinet mounting support device economically available to the buying public.

Still yet another object of the present invention is to provide a new cabinet mounting support device which provides in the apparatuses and methods of the prior art some of the advantages thereof, while simultaneously overcoming some of the disadvantages normally associated therewith.

Still another object of the present invention is to provide a new cabinet mounting support device for supporting a cabinet at a selected height for mounting the cabinet.

Yet another object of the present invention is to provide a new cabinet mounting support device which includes a base plate. A substantially hollow first tubular member is elongated and has a first end securely coupled to a top surface of the base plate such that the first tubular member is in a generally vertical orientation. The first tubular member has a plurality of pairs of opposed and aligned apertures therein extending between the first and second ends of the first tubular member. A second tubular member is elongated and has a first end and a second end. The second tubular member is substantially hollow. The first end is movably extendable into a second end of the first tubular member such that the second tubular member is telescopic with respect to the first tubular member. The second tubular member has a pair of opposed apertures therein positioned generally adjacent to the first end of the second tubular member. A pin is removably extendable through a pair of opposed apertures in the first tubular member and into the apertures in the second tubular member. A support portion rotatably supports a cabinet on the second end of the second tubular member comprising.

Still yet another object of the present invention is to provide a new cabinet mounting support device that has a rotating support assembly for accurately positioning the cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
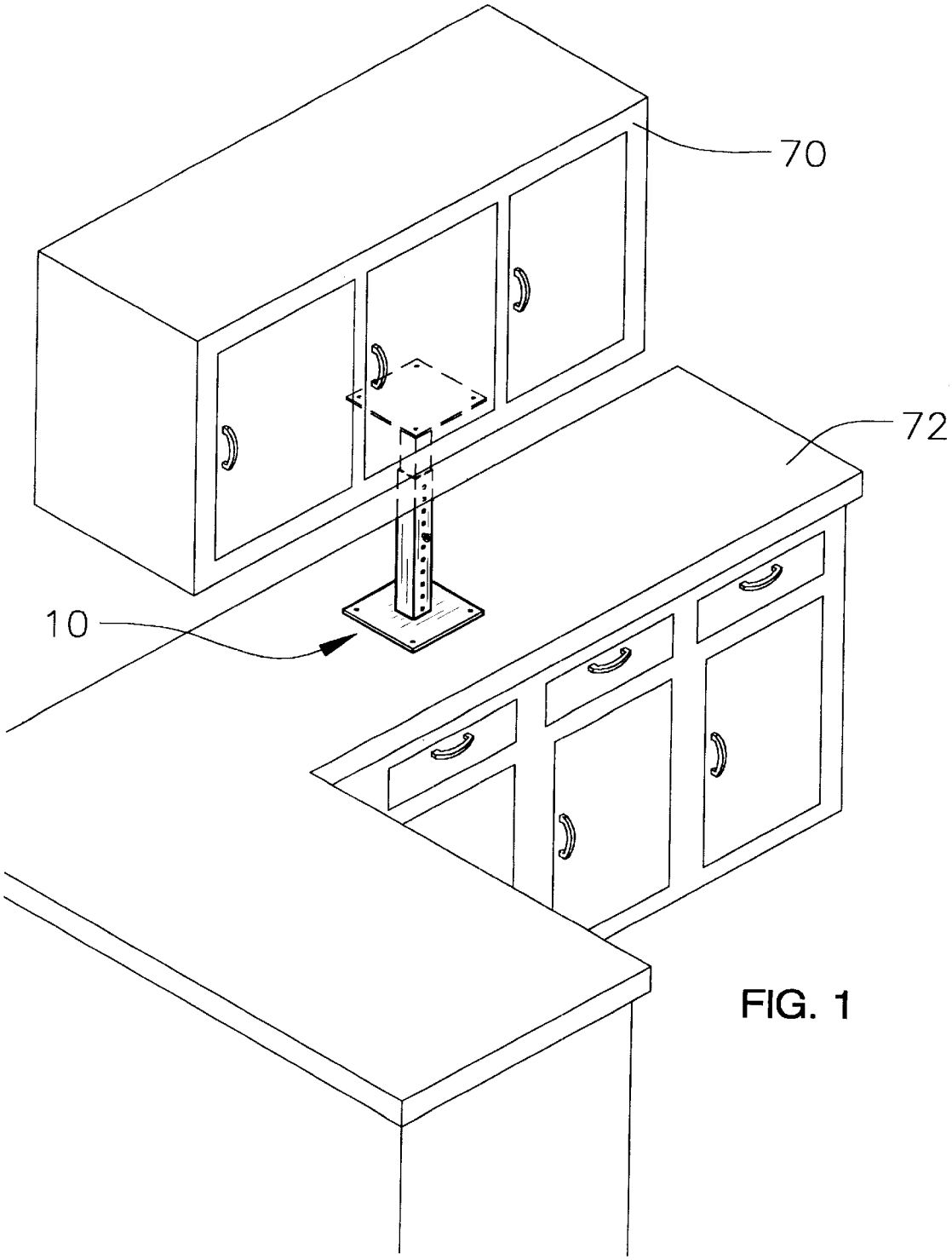
FIG. 1 is a schematic perspective in-use view of a new cabinet mounting support device according to the present invention.
Figure 2:
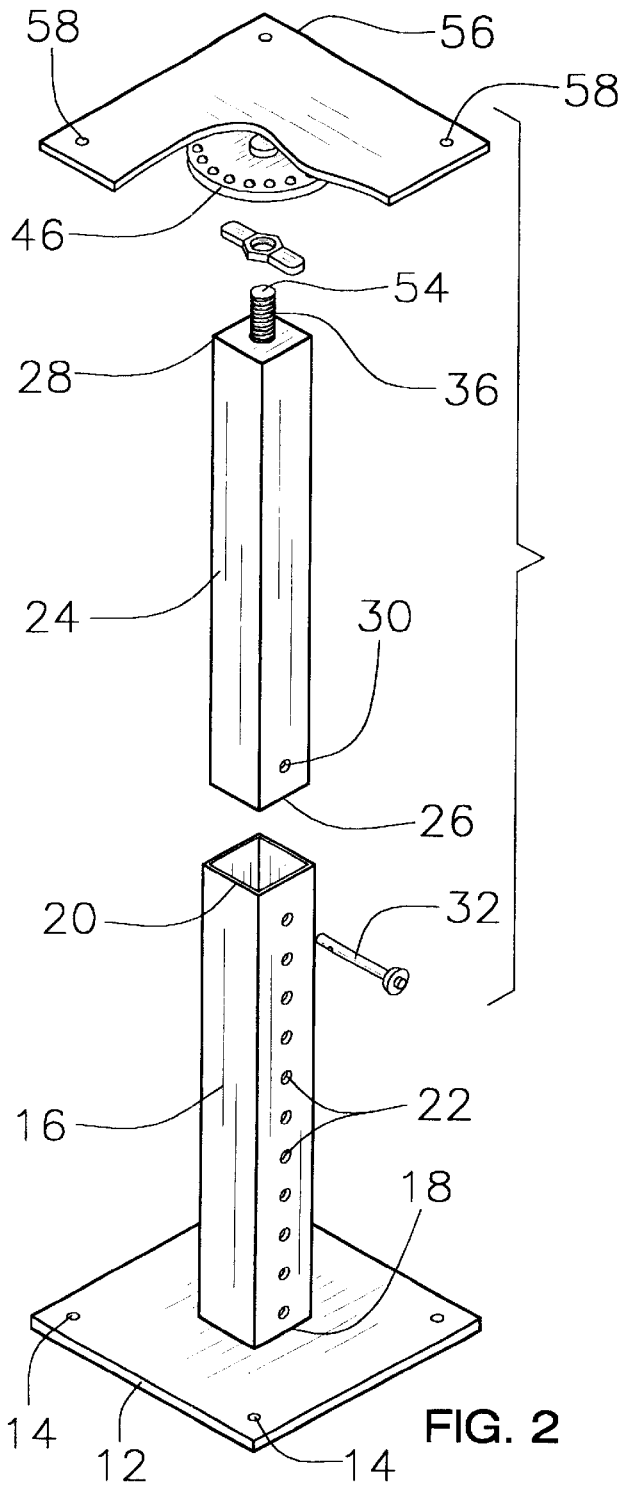
FIG. 2 is a schematic perspective view of the present invention.
Figure 3:
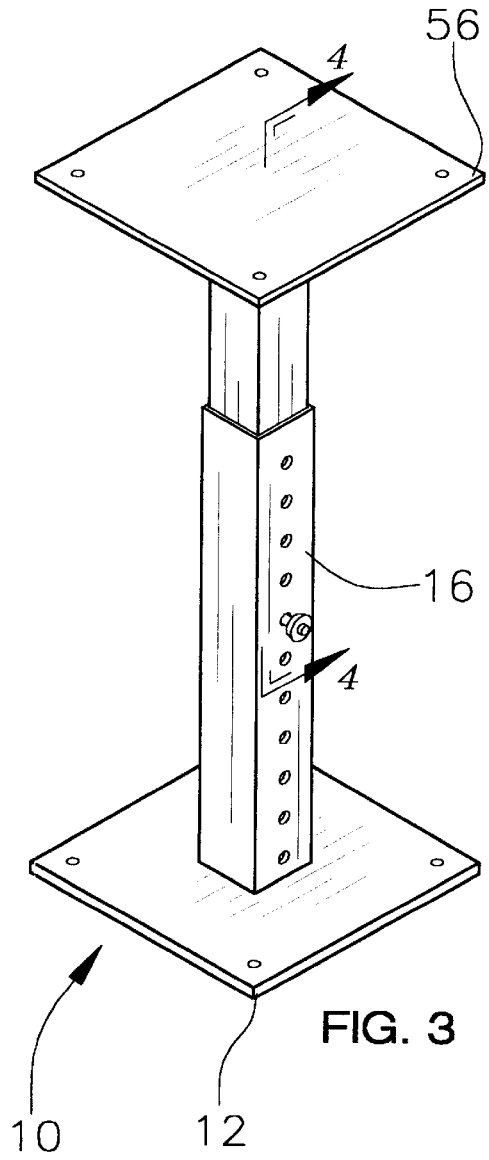
FIG. 3 is a schematic perspective view of the present invention.
Figure 4:
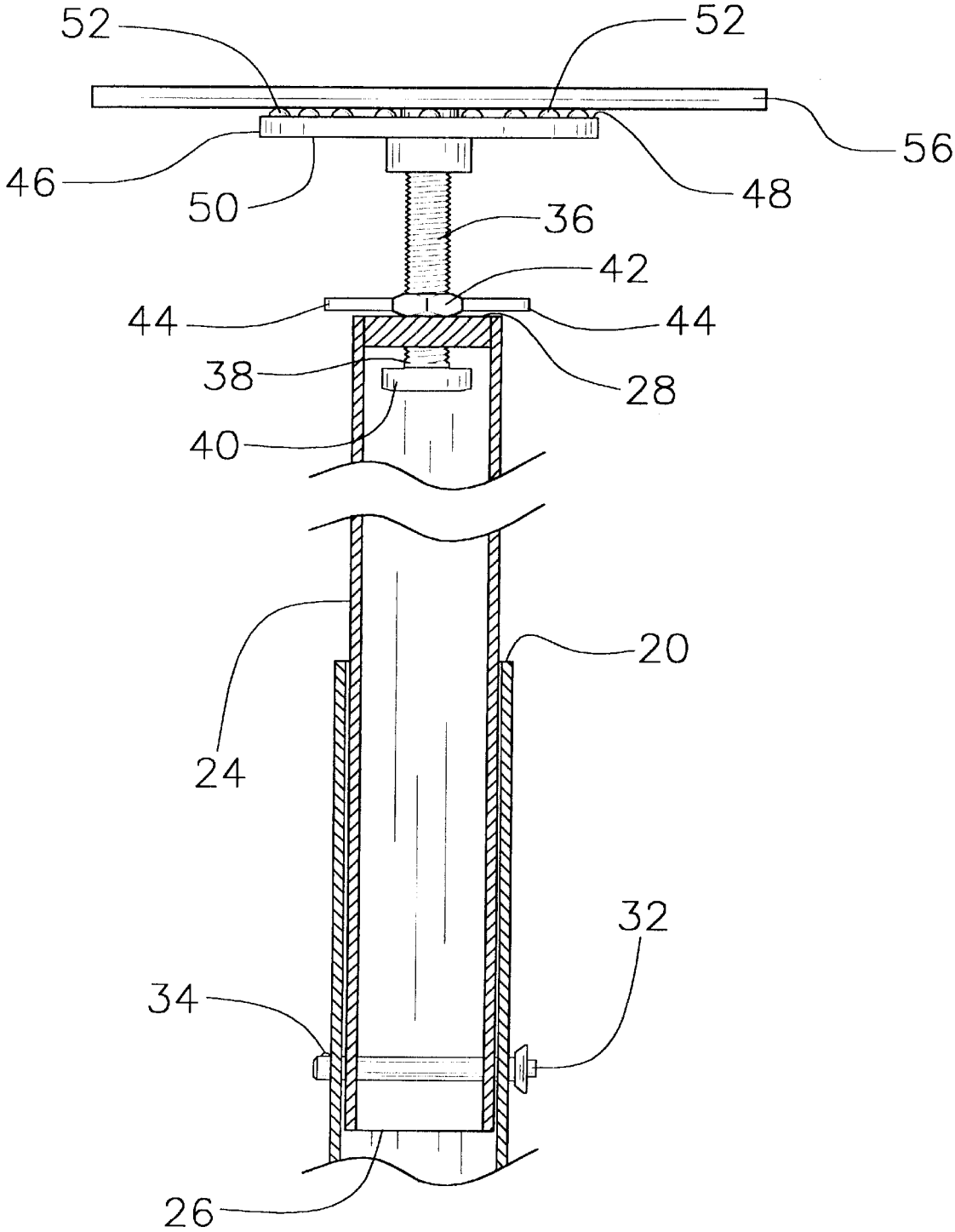
FIG. 4 is a schematic cross-sectional view taken along line 4—4 of the present invention.

With reference now to the drawings, and in particular to FIGS. 1 through 4 thereof, a new cabinet mounting support device embodying the principles and concepts of the present invention and generally designated by the reference numeral 10 will be described.

As best illustrated in FIGS. 1 through 4. the cabinet mounting support device 10 generally comprises a base plate 12 having a plurality of spaced holes 14 extending therethrough and positioned generally adjacent to a peripheral edge of the base plate 12. The base plate 12 has a generally rectangular shape. The base plate 12 preferably has a width generally between 6 inches and 10 inches and a length preferably generally between 6 inches and 10 inches.

A first tubular member 16 is elongated and has a first end 18 and a second end 20. The tubular member 16 is substantially hollow. The first end 18 is securely coupled to a top surface of the base plate 12 such that the first tubular member 16 is in a generally vertical orientation. The second end 20 of the tubular member is open. The first tubular member 16 has a plurality of pairs of opposed and aligned apertures 22 therein extending between the first 18 and second 20 ends of the first tubular member 16.

A second tubular member 24 is elongated and has a first end 26 and a second end 28. The second tubular member 24 is substantially hollow. The first end 26 is movably extendable into the second end 20 of the first tubular member 16 such that the second tubular member 24 is telescopic with respect to the first tubular member 16. The second tubular member 24 has a pair of opposed apertures 30 therein positioned generally adjacent to the first end 26 of the second tubular member 24. Each of the first 16 and second 24 tubular members has a length generally between 10 inches and 15 inches.

A pin 32 is removably extendable through a pair of opposed apertures 22 in the first tubular member 16 and into the apertures 30 in the second tubular member 24 for securing the first tubular member 16 to the second tubular member 24 at a selected length. The pin 32 preferably has a ball bearing 34 biased outwardly therefrom.

A support portion rotatably supports a cabinet 70 on the second end 28 of the second tubular member 24. The support portion includes a threaded rod 36 threadably coupled to and extending through the second end 28 of the second tubular member 24. A first end 38 of the rod is positioned within the second tubular member 24 and has a plate 40 securely attached thereto. The threaded rod 36 preferably has a length between 1 inch and 3 inches.

A nut 42 threadably engages the threaded rod 36 and is positioned outside of the second tubular member 24. The nut 42 has a pair of protruding members 44 is integrally coupled to the nut 42 and extend away therefrom. The nut may be a conventional wing nut.

A disc portion 46 has a top side 48 and a bottom side 50. The top side 48 has a plurality of bearings 52 rotatably coupled thereto. A second end 54 of the rod 36 is threadably coupled to a central portion of the bottom side 50 of the disc portion 46.

A support plate 56 is rotatably coupled to the top side 48 of the disc portion 46 such that the support plate 56 is abutting the bearings 52. The support plate 56 has a plurality of spaced holes 58 extending therethrough. The support plate 56 has a width generally between 6 inches and 10 inches and a length generally between 6 inches and 10 inches. The support and base plates have holes 14, 58 therein for selectively securing them to a second cabinet 72 or the cabinet 70 to be mounted for greater stability by extending a screw through the holes 14, 58.

In use, the second tubular member 24 is extended outward of the first tubular member 16 so that the base plate 12 and the support plate 56 are a selected distance away from each other. The cabinet 70 is positioned on the support plate 56. The support plate 56 is rotatable for maneuvering the cabinet 70. The nut 42 may be rotated to lift or lower the threaded rod 36 with respect to the second end 28 of the second tubular member 24 to move the cabinet 70 up and down a relatively small amount of height to accurately position the cabinet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a base cabinet having an upper surface;

an upper cabinet;

a cabinetry installation support device adjustably vertically supporting said upper cabinet on said base cabinet, said support device comprising:

a base plate resting on the upper surface of said base cabinet, said base plate having a plurality of spaced holes extending therethrough positioned generally adjacent to a peripheral edge of said plate, said base plate having a generally rectangular shape, said base plate having a width generally between 6 inches and 10 inches and a length generally between 6 inches and 10 inches;

a first tubular member being elongated and having a first end and a second end, said tubular member being substantially hollow, said first end being securely coupled to a top surface of said base plate such that said first tubular member is in a generally vertical orientation, said second end of said tubular member being open, said first tubular member having a plurality of pairs of opposed and aligned apertures therein extending between said first and second ends of said first tubular member;

a second tubular member being elongated and having a first end and a second end, said second tubular member being substantially hollow, said first end of said second tubular member being movably extendable into said second end of said first tubular member such that said second tubular member is telescopic with respect to said first tubular member, said second tubular member having a pair of opposed apertures therein positioned generally adjacent to said first end of said second tubular member;

a pin being removably extendable through a pair of opposed apertures in said first tubular member and into said apertures in said second tubular member for securing said first tubular member to said second tubular member at a selected length;

a support portion rotatably supporting said upper cabinet on said second end of said second tubular member, said support portion comprising;

a threaded rod being threadably coupled to and extending through said second end of said second tubular member, a first end of said rod being positioned within said second tubular member and having a plate securely attached thereto, said threaded rod having a length generally between 1 inch and 3 inches;

a nut threadably engaging said threaded rod and being positioned outside of said second tubular member, said nut having a pair of protruding members being integrally coupled to said nut and extending away therefrom;

a disc portion having a top side and a bottom side, said top side having a plurality of bearings rotatably coupled thereto, a second end of said rod being threadably coupled to a central portion of said bottom side of said disc portion; and a support plate being rotatably coupled to said top side of said disc portion such that said support plate is abutting said bearings, said support plate having a plurality of spaced holes extending therethrough, said support plate having a width generally between 6 inches and 10 inches and a length generally between 6 inches and 10 inches.

* * * * *